US009020102B2

(12) United States Patent
Amemiya et al.

(10) Patent No.: US 9,020,102 B2
(45) Date of Patent: Apr. 28, 2015

(54) X-RAY OPTICAL APPARATUS

(71) Applicant: Canon Kabushiki Kaisha, Tokyo (JP)

(72) Inventors: Mitsuaki Amemiya, Saitama (JP); Ichiro Nomura, Atsugi (JP); Takeo Tsukamoto, Kawasaki (JP); Akira Miyake, Nasukarasuyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 13/778,780

(22) Filed: Feb. 27, 2013

(65) Prior Publication Data

US 2013/0235980 A1 Sep. 12, 2013

(30) Foreign Application Priority Data

Mar. 9, 2012 (JP) ..... 2012-053167

(51) Int. Cl.
*G21K 1/06* (2006.01)

(52) U.S. Cl.
CPC ..... *G21K 1/06* (2013.01); *G21K 2201/064* (2013.01)

(58) Field of Classification Search
CPC ..... G21K 1/06; G21K 2201/064
USPC ..... 378/70, 84, 145
See application file for complete search history.

(56) References Cited

U.S. PATENT DOCUMENTS

| | | | | |
|---|---|---|---|---|
| 6,266,392 | B1 | 7/2001 | Fujinawa et al. | 378/149 |
| 7,742,566 | B2 | 6/2010 | Hopkins et al. | 378/84 |
| 2002/0159561 | A1 * | 10/2002 | Cederstrom | 378/84 |
| 2003/0142786 | A1 * | 7/2003 | Houge | 378/84 |
| 2003/0205676 | A1 * | 11/2003 | Nelson et al. | 250/370.09 |
| 2009/0041198 | A1 * | 2/2009 | Price et al. | 378/147 |
| 2013/0243156 | A1 | 9/2013 | Tsukamoto et al. | |
| 2013/0243163 | A1 | 9/2013 | Masaki et al. | |
| 2013/0243164 | A1 | 9/2013 | Iizuka et al. | |

FOREIGN PATENT DOCUMENTS

| | | |
|---|---|---|
| JP | H10-508947 | 9/1998 |
| JP | 2000-137098 | 5/2000 |
| JP | 2004-089445 | 3/2004 |
| WO | 96/27194 | 9/1996 |

* cited by examiner

*Primary Examiner* — Irakli Kiknadze
(74) *Attorney, Agent, or Firm* — Fitzpatrick, Cella, Harper & Scinto

(57) ABSTRACT

The present invention provides an X-ray optical apparatus including an X-ray reflective structure in which at least three reflective substrates are arranged with an interval and an X-ray which is incident into a plurality of X-ray passages whose both sides are put between the reflective substrates is reflected from the reflective substrate at both sides of the X-ray passage to be parallelized and emitted from the X-ray passage. When an edge of the X-ray reflective structure is an inlet of the X-ray and the other edge is an outlet of the X-ray, a pitch of the reflective substrates at the outlet is larger than a pitch at the inlet. Therefore, it is possible to efficiently parallelize the incident X-ray to be emitted with a simple structure.

6 Claims, 5 Drawing Sheets

X-RAY OPTICAL APPARATUS

BACKGROUND OF THE INVENTION

1. Field of the Invention

The present invention relates to an X-ray optical apparatus that radiates an X-ray onto an object, and particularly, to an X-ray optical apparatus that parallelizes and emits the X-ray which travels in a divergence manner.

2. Related Background Art

An X-ray optical apparatus that one-dimensionally parallelizes an X-ray has been known. An example of such an X-ray optical apparatus is a solar slit in which metal flat panels are laminated with a regular interval. In the solar slit, a non-parallel component of the X-ray is absorbed by the metal flat panel and only a predetermined range of a parallel component of the X-ray passes through. If the X-ray is reflected from the metal flat panel, the non-parallel component of the X-ray that passes the solar slit is increased and a degree of parallelization is lowered. Japanese Patent Application Laid-Open No. 2000-137098 discloses that a surface of a metal foil is formed to have a surface roughness to prevent the reflection and only a predetermined parallel component of the X-ray passes the solar slit to form a parallel X-ray beam with high precision.

Japanese Patent Application Laid-Open No. 2004-89445 discloses that a collimator, in which a plurality of minute capillaries is two-dimensionally arranged, is combined with multiple X-ray sources, which are arranged in a two-dimensional matrix, to parallelize an X-ray which is emitted from the capillary.

Further, Japanese Patent Application Publication (Translation of PCT Application) No. H10-508947 discloses that a divergence X-ray, which is diverged from a small spotlight type of an X-ray source, is efficiently captured in a monolithic optical device, which includes a plurality of hollow glass capillaries, to form a quasi-parallel beam.

In the technology disclosed in Japanese Patent Application Laid-Open No. 2000-137098, there is a problem in that since only a parallel component of the X-ray is taken, only a very small part of generated X-ray is used and the usage efficiency is low. Further, a power, which is supplied to the X-ray source, has a limitation due to the influence of the heat generation of the X-ray source, so that an amount of irradiated X-ray is also limited. Therefore, it is difficult to improve an illuminance of the X-ray.

In the technology disclosed in Japanese Patent Application Laid-Open No. 2004-89445, it is difficult to form uniform capillaries in the collimator. It is also difficult to two-dimensionally arrange the X-ray sources with high density.

In the technology disclosed in Japanese Patent Application Publication (Translation of PCT Application) No. H10-508947, the hollow glass capillaries are fused together and plastically shaped. Therefore, it is difficult to form uniform capillaries.

It is an object of the invention to provide an X-ray optical apparatus which is capable of efficiently parallelizing the generated X-ray to be emitted with a simple configuration.

SUMMARY OF THE INVENTION

According to the present invention there is an X-ray optical apparatus including an X-ray reflective structure in which at least three reflective substrates are laminated so as to match both edges with an interval and an X-ray which is incident into an X-ray passage formed by a space, both sides of the passage being put between the reflective substrates, is reflected from the reflective substrate at both sides of the X-ray passage and then emitted from the X-ray passage. The at least three reflective substrates have a constant and equal thickness. When an edge of the X-ray reflective structure is an inlet of the X-ray and the other edge is an outlet of the X-ray, a pitch of the reflective substrates at the outlet is larger than a pitch of the reflective substrates at the inlet.

According to the present invention, it is possible to efficiently parallelize the generated X-ray with a simple structure. Further, since a shape precision of the X-ray reflective substrate is loose or not strict, it is easy to assemble the X-ray reflective structure or adjust a position of the X-ray reflective structure.

Further features of the present invention will become apparent from the following description of exemplary embodiments with reference to the attached drawings.

DETAILED DESCRIPTION OF THE PREFERRED EMBODIMENTS

Preferred embodiments of the present invention will now be described in detail in accordance with the accompanying drawings.

The present invention relates to an X-ray optical apparatus that includes an X-ray reflective structure (hereinafter, referred to as a "slit lens") to parallelize an X-ray diverged from an X-ray source and may be applied to an X-ray imaging apparatus such as an X-ray CT.

(1) Slit Lens

Figure 1A:
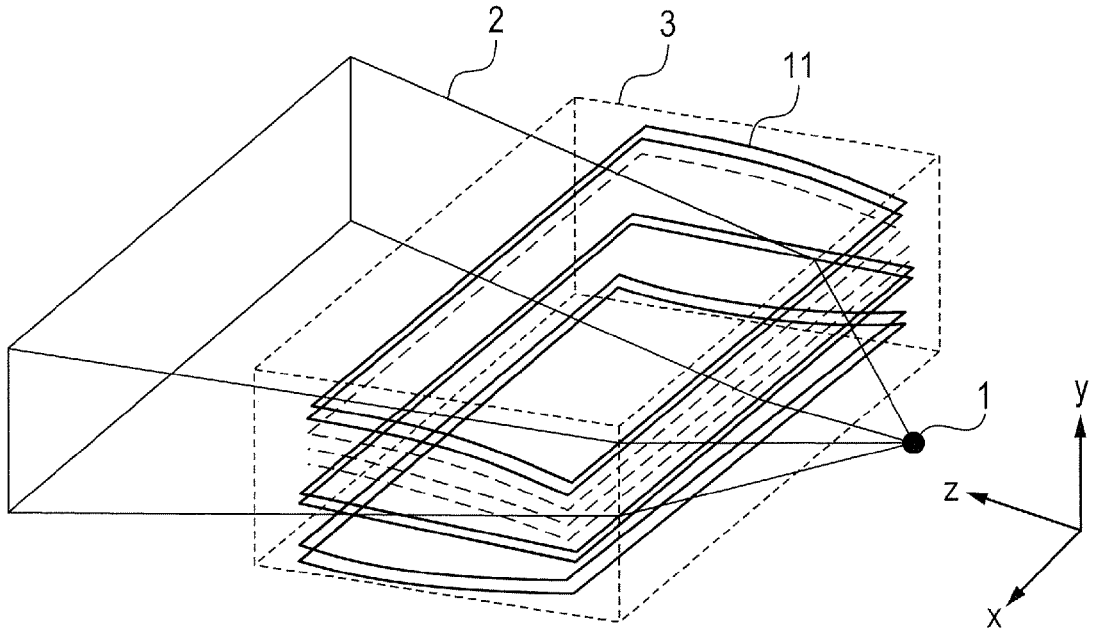
FIG. 1A is a schematic diagram illustrating a concept of the present invention.
Figure 8A:
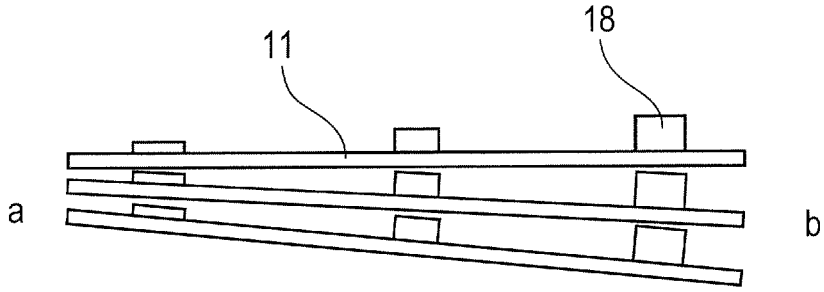
FIG. 8A is a schematic diagram illustrating a configuration of a slit lens according to an exemplary embodiment of the present invention.
Figure 8B:
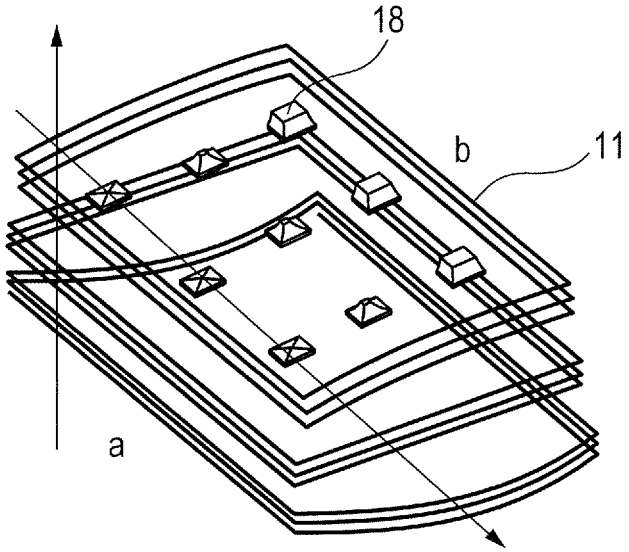
FIG. 8B is a schematic diagram illustrating a configuration of a slit lens according to an exemplary embodiment of the present invention.

As illustrated in FIG. 1A, a slit lens 3 has a structure in which at least three X-ray reflective substrates (hereinafter, referred to as reflective substrate) 11 are laminated so as to match both edges with an interval. Preferably, each of the reflective substrates has a constant thickness and the at least three reflective substrate have the same thickness. As illustrated in FIGS. 8A and 8B, spacers 18 having different heights are disposed between the adjacent reflective substrates. By the spacers 18, intervals between the reflective substrates 11 are formed so that an interval at an outlet b side, which is an edge of the slit lens 3, is larger than an interval at an inlet a side of the X-ray which is the other edge of the slit lens 3. The interval between the reflective substrates 11 is gradually increased from the inlet of the X-ray to the outlet of the X-ray. The spacers 18 have a pillar shape (for example, a quadrangular prism) and are disposed between the reflective substrates with a predetermined interval. Further, the spacers 18 are disposed at the same position on the different layers of reflective substrates 11 (disposed at the overlapping position). The spacers 18 are disposed so as to be bonded with the reflective substrates 11. However, the reflective substrates 11 and the spacers 18 may be integrally formed by etching a glass substrate. Further, in FIG. 8A, even though the reflective substrates 11 are illustrated as a flat substrate, actually, the reflective substrates 11 are laminated so as to be curved with a predetermined curvature as illustrated in FIG. 8B.

X-rays 2, which are incident into a plurality of passages (hereinafter, referred to as an "X-ray passage") formed by a space whose both sides are put between the reflective substrates 11, are reflected from the reflective substrate 11 at both sides of the X-ray passage to be parallelized and emitted from the X-ray passages. The "parallelization" in the present invention refers that an X-ray component in a laminated direction (y direction) of the reflective substrate 11 is reduced and the emission direction of the X-ray becomes parallel (collimates) to a plane (xz plane) perpendicular to the y direction.

(2) Resolving Power

Figure 1B:
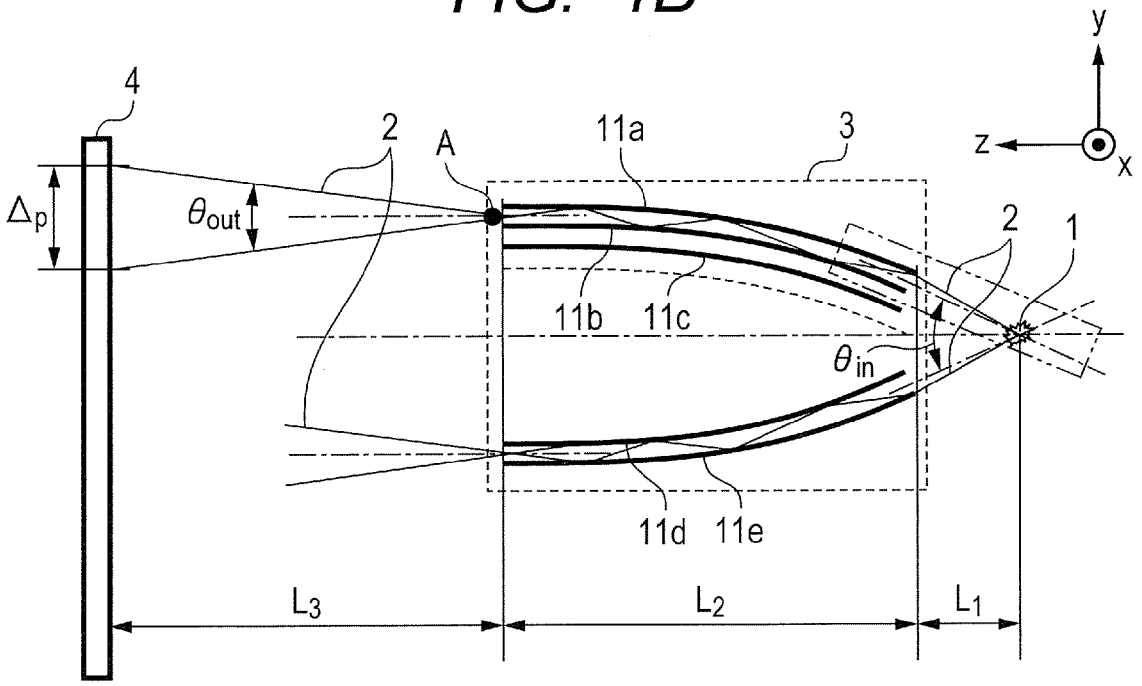
FIG. 1B is a schematic diagram illustrating an X-ray optical apparatus according to the first exemplary embodiment of the present invention.

In an X-ray imaging apparatus to which the present invention is applied, a penumbra amount (resolution) will be described below, which is generated when an X-ray, which is incident into the X-ray passage of the slit lens 3 from the X-ray source 1 and passes the X-ray passage, is irradiated onto a sample to project a transmission image onto an X-ray detector 4. FIG. 1A is a schematic diagram of a system illustrating a concept of the present invention and FIG. 1B is a cross-sectional view of an YZ plane that passes through the X-ray source 1 of the system.

When there is an infinitely small object A at the outlet of the slit lens 3 and a defocused state of an image that transmits the object A is defined as a penumbra amount $\Delta_p$ of the image, the penumbra amount $\Delta_p$ is represented by Equation 1 using a divergence angle $\theta_{out}$ of the X-ray at the outlet of the slit lens 3 and a distance $L_3$ between the outlet of the slit lens 3 and the X-ray detector 4 in an opposite direction.

$$\Delta_p = L_3 \times \theta_{out} \quad \text{(Equation 1)}$$

Equation 1 is established for the X-ray which is emitted from the X-ray passage.

A resolving power of an X-ray imaging apparatus is lowered as the penumbra amount $\Delta_p$ is increased. Therefore, in order to increase the resolving power, if the distance $L_3$ is constant, it is important to lower the divergence angle $\theta_{out}$. In other words, it is important to increase the degree of parallelization of the X-ray which is emitted from the X-ray passages in the slit lens 3.

The resolving power of the X-ray imaging apparatus is determined by not only the half shade amount $\Delta_p$ but also larger one of the penumbra amount $\Delta_p$ and a pixel size $\Delta_d$ of the X-ray detector 4 (for example, flat panel detector (FPD)). If the pixel size $\Delta_d$ is small, the X-ray detector 4 becomes expensive and it takes time to perform data transfer processing. In the meantime, for lowering the penumbra amount $\Delta_p$, for example, a size of the optical source of the X-ray source is required to be reduced, so that a load applied to an optical system is increased as described below. Therefore, it is important to keep a balance between the pixel size $\Delta_d$ and the penumbra amount $\Delta_p$. If an acceptable range of a ratio of the pixel size $\Delta_d$ and the penumbra amount $\Delta_p$ is two, the following Equation 2 is established.

$$0.5 < \Delta_p/\Delta_d < 2 \quad \text{(Equation 2)}$$

(3) Parallelization Principle

Figure 2:
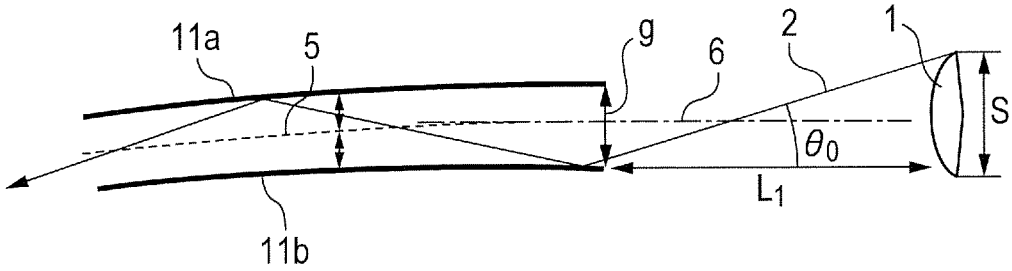
FIG. 2 is an explanation view explaining an X-ray reflective structure according to an exemplary embodiment of the present invention.

A principle (parallelization principle) of parallelizing the X-ray, which is emitted from the X-ray passages in the slit lens 3, will be described. FIG. 2 is an enlarged view of a range enclosed by a two-dot chain line in the system illustrated in FIG. 1B. Hereinafter, a case where a thin glass plate is used as the reflective substrate 11 will be described. However, the reflective substrate 11 may be metal.

Figure 3:
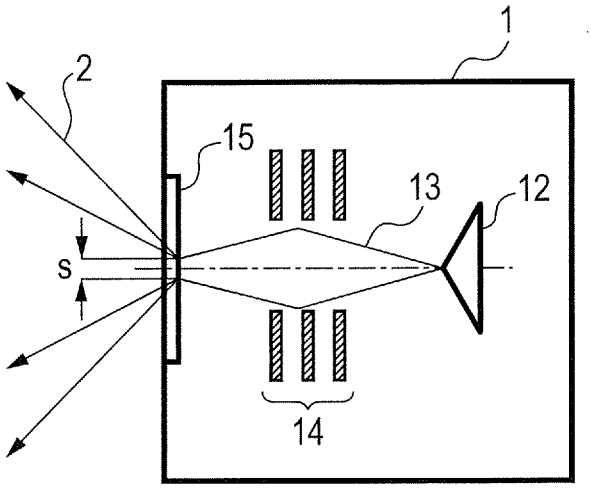
FIG. 3 is a schematic diagram illustrating an X-ray source according to an exemplary embodiment of the present invention.

The X-ray 2 which is emitted from the X-ray source 1 is divergence light and is radiated in all directions. An X-ray source illustrated in FIG. 3 may be used as the X-ray source 1. The slit lens 3 is disposed so as to be separated by a distance $L_1$ from the X-ray source in the opposite direction of the X-ray source 1. The slit lens 3 is arranged such that the thin glass plates having a gentle curvature are arranged with predetermined pitch and a pitch at the outlet of the X-ray is larger than a pitch at the inlet of the X-ray. Here, the pitch refers to a distance between top surfaces or bottom surfaces of the adjacent reflective substrates. 10 to 1000 sheets of the thin glass plates each having a thickness of 1 μm to 100 μm are laminated and the X-ray may be reflected from both surfaces of the thin glass plate. An X-ray 2, which is incident into the X-ray passage (air) between the thin glass plates 11*a* and 11*b*, travels while being reflected from both the thin glass plates 11*a* and 11*b* and then is emitted from the X-ray passage. Similarly, in the X-ray passage between the thin glass plate 11*b* and the thin glass plate 11*c*, the incident X-ray 2 travels while being reflected from both the thin glass plates 11*b* and 11*c* and then is emitted from the X-ray passage, which is similar in the X-ray passage between other adjacent thin glass plates.

As described above, as the X-ray travels in the X-ray passage in the slit lens 3, an X-ray whose traveling direction is not a parallel direction is reflected multiple times from the thin glass plate and the traveling direction gradually becomes parallel. Therefore, the X-ray is parallelized and emitted from the X-ray passage. Further, an X-ray which travels in a parallel direction is emitted from the X-ray passage as it is. Accordingly, it is possible to efficiently parallelize the X-ray to be emitted with a simple structure. By doing this, the penumbra amount $\Delta_p$, which is formed on the X-ray detector 4, also becomes lower.

Here, a virtual plane 5 is set in a position which is separated from both the thin glass plates of the X-ray passages with the same distance and a tangential plane 6 of the virtual plane 5 at the inlet of the slit lens 3 is considered. If X-ray sources 1 are disposed on tangential planes of the plurality of virtual planes 5 at the inlet side, more X-rays may be incident into the X-ray passages. In case of the X-ray source 1 illustrated in FIG. 3, it is preferred that an X-ray generating unit which generates an X-ray with a light source size s be disposed on the tangential planes of the plurality of virtual planes 5 at the inlet side. If all the tangential planes 6 of the plurality of virtual planes 5, which are set between the adjacent thin glass plates, at the inlet side intersect on a common straight line and the X-ray source 1 is disposed on the straight line, a size of the X-ray source 1 may be smaller. Further, if the thin glass plate at the outlet of the slit lens 3 is parallel, in other words, if the tangential planes 6 of the plurality of virtual planes 5 at the outlet side are approximately parallel, the degree of parallelization of the X-rays emitted from the X-ray passages may be increased.

Figure 4:
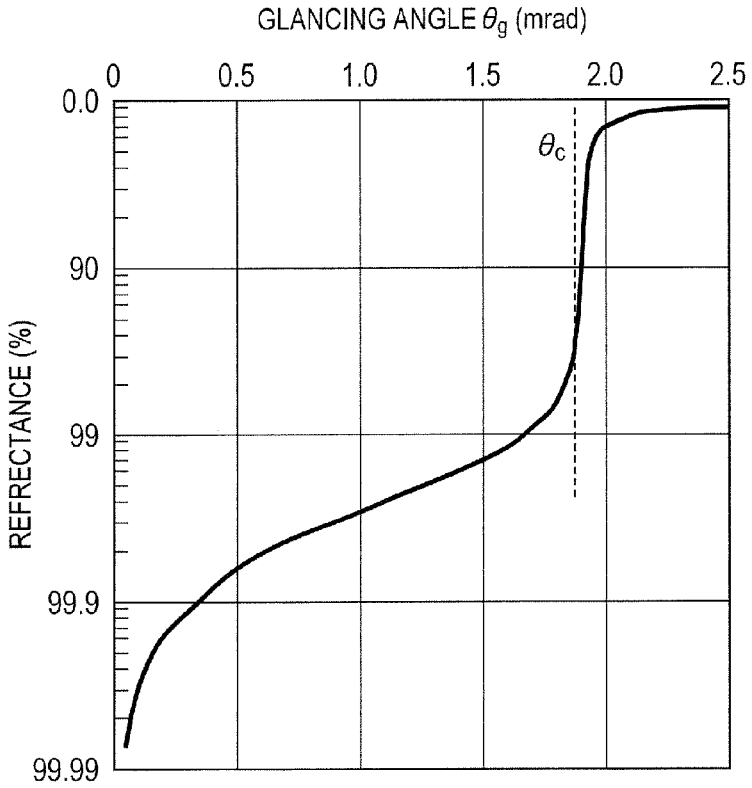
FIG. 4 is a graph illustrating an X-ray reflectance of a quartz substrate.

FIG. 4 illustrates an X-ray reflectance of a quartz substrate with respect to an X-ray having a wavelength of 0.071 nm. A horizontal axis is a glancing angle $\theta_g$ at which the X-ray is incident onto the X-ray passage and a vertical axis is a reflectance of the X-ray. When the glancing angle $\theta_g$ is 0.5 mrad, the reflectance of the X-ray is 99.8% or higher. Therefore, it can be understood that 90% or more of the X-ray passes the slit lens 3 even if the X-ray is reflected 50 times. In the meantime, when the glancing angle $\theta_g$ is 1.8 mrad, the reflectance of the X-ray is rapidly attenuated. In this case, the glancing angle $\theta_g$ is referred to as a critical angle and denoted by $\theta_c$. When the X-ray source 1 is disposed on the tangential planes 6 of the plurality of virtual planes 5 at the inlet side, if the angular variation of the tangential planes 6 is increased, a variation in an angle at which each of the thin glass plates brings to the X-ray source into view is generated. Then, the X-ray 2 which is emitted from the X-ray source 1 will not be reflected on a position where the glancing angle $\theta_g$ is larger than the critical angle $\theta_c$ in the thin glass plate. Accordingly, when a distance between the X-ray source 1 and the inlet of the slit lens 3*a* in the opposite direction is $L_1$ and a critical angle of the glancing angle $\theta_g$ at which the X-ray is incident onto the X-ray passage is $\theta_c$, the distance $\Delta_s$ between the X-ray source 1 and the X-ray passage in a direction perpendicular to the opposite direction is required to satisfy the following Equation 3.

$$\Delta_s < L_1 \times \theta_c \quad \text{(Equation 3)}$$

Therefore, it is required to determine a relative position of the slit lens 3 and the X-ray source 1, that is, a relative position of the thin glass plate and the X-ray source 1 so as to satisfy Equation 3.

Here, a slit lens 3 will be described, in which the interval between adjacent thin glass plates is constant and thicknesses of all thin glass plates are formed such that a thickness at the outlet side is larger than a thickness at the inlet side as illustrated in FIG. 1B. Such a slit lens 3 may be manufactured by laminating thin glass plates having a wedge shaped thickness. Then, a maximum glancing angle $\theta_{gmax}$, at which the X-ray being incident onto the X-ray passage is reflected from the thin glass plate, is represented by Equation 4.

$$\theta_{gmax} = (s+g)/2L_1 \quad \text{(Equation 4)}$$

Here, s indicates a size of the X-ray source 1 (diameter of the light source) and is 2σ when an intensity distribution of the light source may be approximated by a Gaussian distribution. g is an interval between adjacent thin glass plates. However, $\theta_{gmax}$ needs to be smaller than the critical angle $\theta_c$.

If the thin glass plates are parallel to each other at the outlet of the slit lens 3, the divergence angle $\theta_{out}$ of the X-ray, which is emitted from each of the X-ray passages in the slit lens 3, is represented by Equation 5.

$$\theta_{out} = 2 \times \theta_{gmax} \quad \text{(Equation 5)}$$

In this case, the penumbra amount $\Delta_p$ is represented by Equation 6 based on Equations 1, 4 and 5.

$$\Delta_p = L_3 \times (s+g)/L_1 \quad \text{(Equation 6)}$$

Further, Equation 7 is established based on Equations 2 and 6.

$$0.5 \times \Delta_d < L_3 \times (s+g)/L_1 < 2 \times \Delta_d \quad \text{(Equation 7)}$$

If the degree of parallelization of the thin glass plate is lowered, the X-ray does not reach a pixel of the X-ray detector 4 that detects an intensity of the X-ray or a pixel having an extremely weak X-ray intensity is generated. In order to remove such troubles, the parallelism $\Delta_{out}$ of all the thin glass plates is required to satisfy larger one of an acceptable value $\Delta_{out\text{-}a}$ in Equation 8a and an acceptable value $\Delta_{out\text{-}b}$ in Equation 8b. Here, $\Delta_d$ indicates a pixel size of the X-ray detector 4.

$$A_{out\text{-}a} < (s+g)/L_1 \quad \text{(Equation 8a)}$$

$$A_{out\text{-}b} < \Delta_d / L_3 \quad \text{(Equation 8b)}$$

Figure 5:
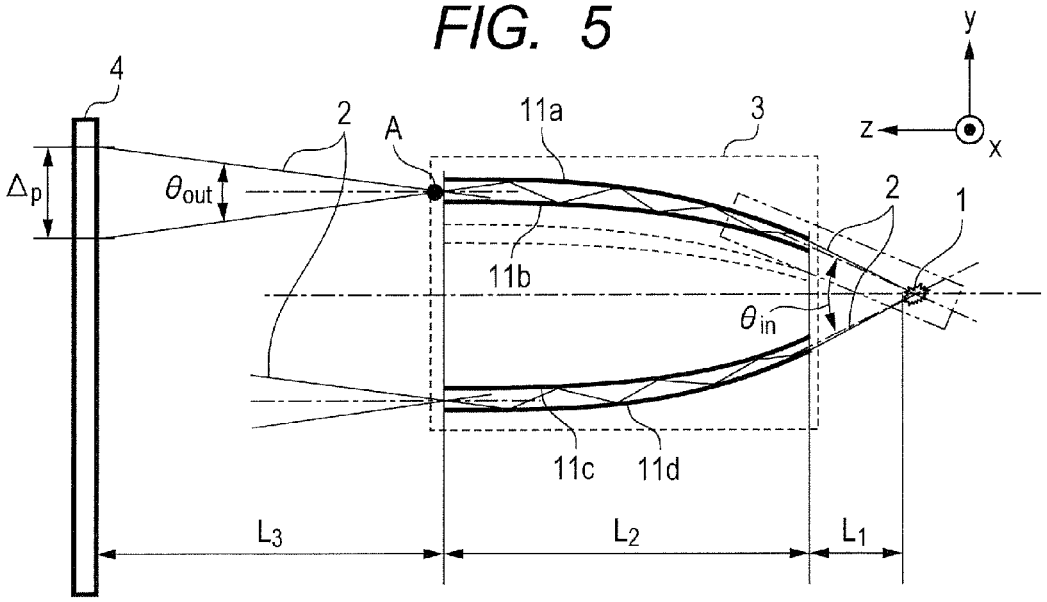
FIG. 5 is a schematic diagram illustrating a modification example of an X-ray optical apparatus according to the second exemplary embodiment of the present invention.
Figure 6:
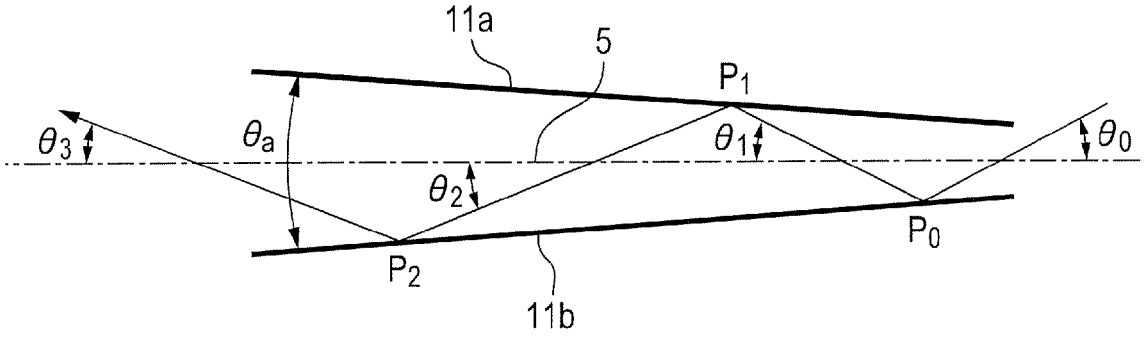
FIG. 6 is an explanation view explaining another X-ray reflective structure according to an exemplary embodiment of the present invention.

Next, a slit lens 3 will be described, in which thicknesses of all thin glass plates are constant and an interval between adjacent thin glass planes at the outlet side is larger than an interval at the inlet side as illustrated in FIG. 5. In order to simplify the description, a straight guide is considered, in which the thin glass plates 11*a* and 11*b* form an angle $\theta_a$ as illustrated in FIG. 6. If an angle between the virtual plane 5 and the X-ray 2 is referred to as a half divergence angle, an X-ray, which is incident into the X-ray passage between the thin glass plates 11*a* and 11*b* with the half divergence angle $\theta_0$ ($0.5 \times \theta_a < \theta_0 < \theta_c$), is reflected at a point $P_0$ of the thin glass plate 11*b* and then reflected at a point $P_1$ of the thin glass plate 11*a*. A half divergence angle $\theta_1$ after the first reflection is represented by Equation 9.

$$\theta_1 = \theta_0 - \theta_a \quad \text{(Equation 9)}$$

Therefore, the angle $\theta_n$ after n-th reflection is represented by Equation 10 in a range of "$\theta_0 - n \times \theta_a > 0$".

$$\theta_n = \theta_0 - n \times \theta_a \quad \text{(Equation 10)}$$

If $\theta_n < 0.5 \times \theta_a$, the X-ray 2 does not reach the thin glass plate, so that the half divergence angle is not varied. Further, if an interval between the adjacent thin glass plates at the outlet side is $g_{out}$, an interval between the adjacent thin glass plates at the inlet side is $g_{in}$ and a length of the thin glass plate is $L_2$, Equation 11 is established.

$$\theta_a = (g_{out} - g_{in})/L_2 \quad \text{(Equation 11)}$$

In this case, since $\theta_a < \theta_{out}$, the penumbra amount $\Delta_p$ is represented by Equation 12 based on Equations 1 and 11.

$$(g_{out} - g_{in}) \times L_3 / L_2 < \Delta_p \quad \text{(Equation 12)}$$

Further, Equation 13 is established based on Equations 2 and 12.

$$0.5 \times \Delta_d < L_3 \times (g_{out} - g_{in})/L_2 < 2 \times \Delta_d \quad \text{(Equation 13)}$$

For the same reason as the above mentioned reason with respect to the slit lens 3 having the structure illustrated in FIG. 1B, even in a slit lens 3 having a structure illustrated in FIG. 5, it is preferred that the thin glass plates at the outlet of the slit lens 3 be parallel to each other. Therefore, the parallelism $\Delta_{out}$ of all the thin glass plates is required to satisfy larger one of an acceptable value $\Delta_{out\text{-}a}$ in Equation 14a and an acceptable value $\Delta_{out\text{-}b}$ in Equation 14b. Here, $\Delta_d$ indicates a pixel size of the X-ray detector 4.

$$\Delta_{out\text{-}a} < (g_{out} - g_{in})/L_2 \quad \text{(Equation 14a)}$$

$$\Delta_{out\text{-}b} < \Delta_d / L_3 \quad \text{(Equation 14b)}$$

In the meantime, a penumbra amount $\Delta_x$ in a dimension where the thin glass plate does not have curvature, that is, direction (x-direction) perpendicular to both an opposite direction between the X-ray source 1 and the inlet of the slit lens 3 and a direction perpendicular to the opposite direction between the X-ray source 1 and the X-ray passage is represented by Equation 15.

$$\Delta_x = s \times L_3 / (L_2 + L_1) \quad \text{(Equation 15)}$$

Therefore the penumbra amount $\Delta_x$ is determined by the relative position of the slit lens 3, the X-ray source 1 and the X-ray detector 4.

Figure 7:
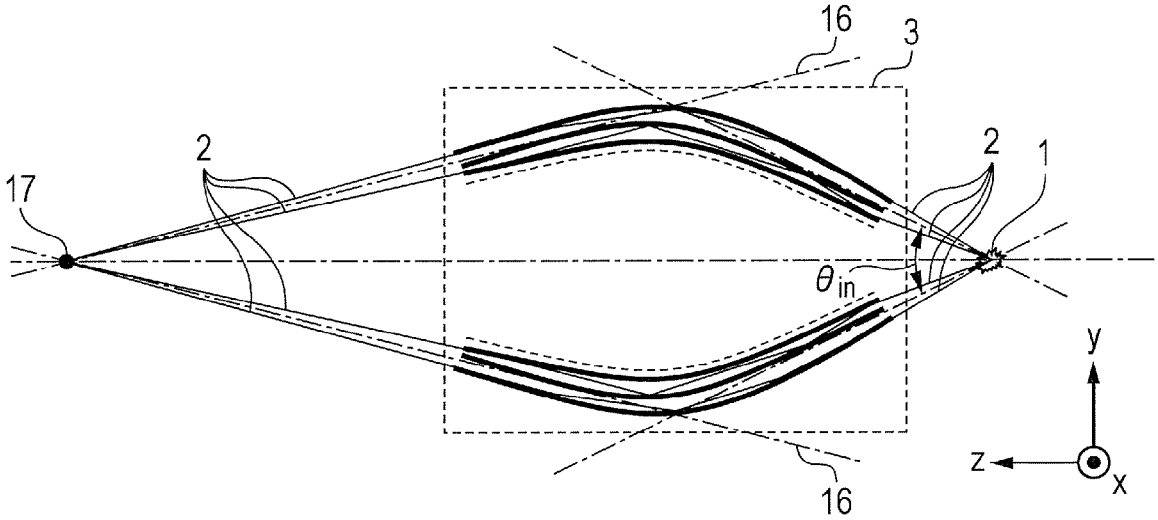
FIG. 7 is a schematic diagram illustrating another modification example of an X-ray optical apparatus according to the third exemplary embodiment of the present invention.

Further, a slit lens 3, where the X-ray source 1 is disposed on the tangential planes of the plurality of virtual planes 5 at the inlet side and the tangential planes 16 of the plurality of virtual planes at the outlet sides intersect on a common straight line 17, may also be applied to the X-ray optical apparatus in accordance with the present invention (see FIG. 7). Such a structure also exerts the effect of the present invention. As illustrated in FIG. 7, if all tangential planes 6 of the plurality of virtual planes 5 at the inlet side intersect on the common straight line and the X-ray source 1 is disposed on the straight line, it is advantageous in that the size of the X-ray source 1 may be reduced. In this case, the common straight line intersecting at the inlet side is a different straight line from the common straight line 17 intersecting at the outlet side.

[First Exemplary Embodiment]

As illustrated in FIG. 1B, the exemplary embodiment includes a slit lens 3 where an interval g between the adjacent thin glass plates is constantly 10 μm, and a thickness of all thin glass plates is 20 μm at the outlet side and 10 μm at the inlet side.

An X-ray 2 radiated from the X-ray source 1 is incident into an X-ray passage between thin glass plates 11*a* and 11*b* and travels while being reflected from both the thin glass plates 11*a* and 11*b*, which is similar in the X-ray passage between other adjacent thin glass plates. A solid angle $\Omega_1$ of the X-ray which is incident into one X-ray passage is proportional to the interval g. However, since the plurality of thin glass plates are arranged so as to be spaced apart from each other with the interval g, even though the interval g is small, the amount of entire X-ray which can be incident into the X-ray passage is proportional to a divergence angle $\theta_m$ and an aperture ratio. Here, the "aperture ratio" refers to a ratio of the gap which occupies in the inlet of the slit lens 3 and the aperture ratio is 50% (=10 μm/(10 μm+10 μm)) in this exemplary embodiment. 50% of X-ray 2, which is radiated from the X-ray source 1 with the divergence angle $\theta_m$ or smaller, is incident into the X-ray passage and travels while being reflected from the thin glass plates and is radiated from the X-ray passage with the divergence angle $\theta_{out}$. An image of the object, which is disposed between the outlet of the slit lens 3 and the FPD, is projected onto the FPD by the radiated X-ray. In this case, a penumbra amount $\Delta_p$ of the image of the object is formed on the FPD in accordance with Equation 1, so that the resolution is lowered.

A method for restricting the lowering of resolution in a predetermined range will be described. Since the penumbra amount $\Delta_p$ is represented by Equation 6, a size s of the X-ray source 1 is represented by Equation 16 based on Equations 2 and 6.

$$0.5\times L_1/L_3\times\Delta_d-g\leq s\leq 2\times L_1/L_3\times\Delta_d-g \quad \text{(Equation 16)}$$

When a distance $L_1$ between the X-ray source 1 and the inlet of the slit lens 3 in the opposite direction is 100 mm, a distance $L_3$ between the outlet of the slit lens 3 and the FPD in the opposite direction is 200 mm, and a pixel size $\Delta_d$ of the FPD is 100 μm, an acceptable range of the size s of the light source is "15 μm≤s≤90 μm". It is required to adjust the size s of the light source within the acceptable range. In the transmissive X-ray source 1 illustrated in FIG. 3, an electron beam 13 radiated from an electron beam source 12 is converged by an electron lens 14 for converging an electron to be focused on a target 15. A size of the electron beam 13 may be easily varied by changing a power of the electron lens 14. In this way, it is possible to adjust the size s of the X-ray source 1.

In the meantime, when the length $L_2$ of the slit lens 3 is 100 mm and the size s of the light source is 90 πam, the penumbra amount $\Delta_x$ is 90 μm in accordance with Equation 15, which is almost equal to the pixel size $\Delta_d$ of the FPD.

As described above, the resolution in a direction perpendicular to both the opposite direction between the X-ray source 1 and the inlet of the slit lens 3 and a direction perpendicular to the opposite direction between the X-ray source 1 and the X-ray passage is also similar to the resolution in the opposite direction between the X-ray source 1 and the inlet of the slit lens 3. Therefore, it is possible to efficiently parallelize the X-ray to be emitted and restrict the lowering of the resolution within a predetermined range with a simple structure.

[Second Exemplary Embodiment]

As illustrated in FIG. 5, the exemplary embodiment includes a slit lens 3 where a thickness of all thin glass plates is constant and an interval between the adjacent thin glass plates is 50 μm at the outlet side $g_{out}$ and 10 μm at the inlet side $g_{in}$.

Similarly to the first exemplary embodiment, an X-ray 2 radiated from an X-ray source 1 is incident into an X-ray passage, travels while being reflected from thin glass plates, and is radiated from the X-ray passage with a divergence angle $\theta_{out}$ so that an image of an object is projected onto an FPD. In this case, the resolution is lowered in accordance with Equation 1.

If a length $L_2$ of the slit lens is 100 mm, an angle $\theta_a$ formed by adjacent thin glass plates is 0.4 mrad. If an X-ray, which is incident with a glancing angle $\theta_g$ of 1.8 mrad which is a critical angle $\theta_a$, is reflected four times, a relationship of "$\theta_n<0.5\times\theta_a$" is satisfied and the divergence angle $\theta_{out}$ is 0.4 mrad or less. If a distance $L_3$ between the outlet of the slit lens 3 and the FPD in the opposite direction is 200 mm, the penumbra amount $\Delta_p$ is 80 μm. Further, if the pixel size $\Delta_d$ is 100 V, Equation 2 is satisfied. Therefore, it is possible to efficiently parallelize the X-ray to be emitted and restrict the lowering of the resolution within a predetermined range with a simple structure.

Further, if the size s of the light source is large, when the X-ray is incident onto the slit lens 3 at an angle which is larger than the critical angle $\theta_c$, the first reflection does not occur, so that the resolution is not lowered. However, an X-ray which is incident at an angle which is larger than the critical angle $\theta_c$ is absorbed by the thin glass plate, so that the X-ray may not pass through the slit lens 3. Accordingly, in order to efficiently use the X-ray radiated from the X-ray source 1, the size s of the light source is required to be adjusted so as to satisfy Equation 17.

$$s<L_1\times 2\theta_c \quad \text{(Equation 17)}$$

[Third Exemplary Embodiment]

As illustrated in FIG. 7, this exemplary embodiment includes a slit lens 3 where if a virtual plane is set in a position which is separated from adjacent thin glass plates with the same distance, an X-ray source is disposed on tangential planes of a plurality of virtual planes at an inlet side and the tangential planes 16 of the plurality of virtual planes at the outlet side intersect on a common straight line 17. Even in accordance with this exemplary embodiment, it is also possible to efficiently parallelize the X-ray to be emitted and restrict the lowering of the resolution within a predetermined range with a simple structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-053617, filed on Mar. 9, 2012, which is hereby incorporated by reference herein in its entirety.

What is claimed is:

1. An X-ray optical apparatus, comprising:

an X-ray reflective structure in which at least three reflective substrates are laminated so as to match both edges with an interval and an X-ray which is incident into an X-ray passage formed by a space, both sides of the passage being put between the reflective substrates, is reflected from the reflective substrate at both sides of the X-ray passage and emitted from the X-ray passage, wherein the at least three reflective substrates are arranged to have a constant and equal thickness, and wherein when an edge of the X-ray reflective structure is an inlet of the X-ray and the other edge is an outlet of the X-ray, a pitch of the reflective substrates at the outlet is larger than a pitch at the inlet, and wherein spacers arranged to have different heights are disposed between the reflective substrates, so that the pitch of the reflective substrates at the outlet side is larger than the pitch at the inlet side.

2. The X-ray optical apparatus according to claim 1, wherein the spacers are arranged to have a pillar shape and are disposed between the reflective substrates with a predetermined interval.

3. The X-ray optical apparatus according to claim 2, wherein the spacers are disposed at the same position on different layers.

4. The X-ray optical apparatus according to claim 1, wherein the reflective substrates and the spacers are integrally formed by etching a glass substrate.

5. The X-ray optical apparatus according to claim 1, further comprising:

an X-ray source, wherein if a virtual plane is set in a position which is separated from the reflective substrates at both sides of the X-ray passage with the same distance, the X-ray source is disposed on tangential planes of a plurality of virtual planes at the inlet and tangential planes of the plurality of virtual planes at the outlet are approximately parallel.

6. The X-ray optical apparatus according to claim 1, further comprising:

an X-ray source, wherein if a virtual plane is set in a position which is separated from the reflective substrates at both sides of the X-ray passage with the same distance, the X-ray source is disposed on tangential planes of a plurality of virtual planes at the inlet and tangential planes of the plurality of virtual planes at the outlet intersect on a common straight line.

* * * * *